US010948161B2

(12) United States Patent
Vang et al.

(10) Patent No.: US 10,948,161 B2
(45) Date of Patent: Mar. 16, 2021

(54) LIGHT FIXTURE

(71) Applicant: Hubbell Incorporated, Shelton, CT (US)

(72) Inventors: Seng Vang, Piedmont, SC (US); Rebecca K. McCall, Flat Rock, NC (US); Jeffrey A. Spitzer, Taylors, SC (US); David A. Simoni, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/179,512

(22) Filed: Nov. 2, 2018

(65) Prior Publication Data

US 2019/0072257 A1 Mar. 7, 2019

Related U.S. Application Data

(63) Continuation of application No. 15/142,980, filed on Apr. 29, 2016, now abandoned.
(Continued)

(51) Int. Cl.

| | |
|---|---|
| ***F21S 4/00*** | (2016.01) |
| ***F21V 7/00*** | (2006.01) |
| ***F21V 5/04*** | (2006.01) |
| ***F21S 8/04*** | (2006.01) |
| ***F21V 5/00*** | (2018.01) |

(Continued)

(52) U.S. Cl.
CPC ..... *F21V 7/0091* (2013.01); *F21S 8/04* (2013.01); *F21V 5/007* (2013.01); *F21V 5/04* (2013.01); *F21V 13/04* (2013.01); *F21Y 2105/10* (2016.08); *F21Y 2115/10* (2016.08)

(58) Field of Classification Search
CPC ..... F21V 13/00; F21V 13/04; F21V 13/14; F21V 5/00; F21V 5/007; F21V 5/008; F21V 5/02; F21V 5/04; F21V 5/045; F21V 5/06; F21V 7/0091; F21V 7/041; F21V 7/048; F21V 7/09; F21V 7/005; F21V 7/0066; F21V 7/0083; F21V 7/04; G02B 6/00; G02B 6/0001
USPC ..... 362/224, 97.1, 555, 559, 561, 223, 225, 362/217.03; 349/62
See application file for complete search history.

(56) References Cited

U.S. PATENT DOCUMENTS 6,819,505 B1 12/2004 Cassarly
7,580,192 B1 8/2009 Chu et al.
(Continued)

OTHER PUBLICATIONS

PCT/US2016/030186 International Search Report and Written Opinion dated Sep. 7, 2016 (13 pages).

*Primary Examiner* — William J Carter
*Assistant Examiner* — Omar Rojas Cadima
(74) *Attorney, Agent, or Firm* — Michael Best & Friedrich, LLP

(57) ABSTRACT

A light fixture includes a housing, a light-emitting element, and a lens extending over the light-emitting element. The housing includes a support surface, and the light-emitting element is coupled to the support surface. The lens includes a refractor portion having an inner surface and an outer surface. The inner surface is positioned proximate the light-emitting element. The inner surface is oriented at an angle such that the light generated by the light-emitting element exhibits total internal reflection within the lens until the light reaches the outer surface.

10 Claims, 13 Drawing Sheets

Related U.S. Application Data

(60) Provisional application No. 62/154,984, filed on Apr. 30, 2015, provisional application No. 62/293,022, filed on Feb. 9, 2016.

(51) Int. Cl.

| | |
|---|---|
| *F21V 13/04* | (2006.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 8,075,165 | B2 | 12/2011 | Jiang et al. | |
| 2003/0206416 | A1 | 11/2003 | Mullally et al. | |
| 2008/0043466 | A1 | 2/2008 | Chakmakjian | |
| 2010/0027256 | A1 | 2/2010 | Kinoshita | |
| 2010/0195317 | A1* | 8/2010 | Oketani | F21S 4/28 362/125 |
| 2011/0096551 | A1* | 4/2011 | Sekela | F21S 4/20 362/296.01 |
| 2011/0149581 | A1 | 6/2011 | Jiang | |
| 2013/0044475 | A1* | 2/2013 | Hutchens | F21V 7/0016 362/235 |
| 2014/0355297 | A1 | 12/2014 | Castillo | |
| 2015/0204491 | A1 | 7/2015 | Yuan | |

* cited by examiner

LIGHT FIXTURE

REFERENCE TO RELATED APPLICATIONS

This application is a continuation of U.S. patent application Ser. No. 15/142,980, filed Apr. 29, 2016, which claims the benefit of prior-filed U.S. Provisional Patent Application No. 62/154,984, filed Apr. 30, 2015, and U.S. Provisional Patent Application No. 62/293,022, filed Feb. 9, 2016. The entire contents of these documents are incorporated by reference herein.

BACKGROUND

The present application relates generally to light fixtures and particularly to a lens for a light-emitting element.

Conventional lighting fixtures include a reflector and a board supporting a number of LEDs. The board is in electrical communication with a power source. A lens, such as a refractor or a diffuser may be positioned over the LEDs.

SUMMARY

In one aspect, a light fixture includes a housing, a light-emitting element, and a lens extending over the light-emitting element. The housing includes a support surface, and the light-emitting element is coupled to the support surface. The lens includes a refractor portion having an inner surface and an outer surface. The inner surface is positioned proximate the light-emitting element. The inner surface is oriented at an angle such that the light generated by the light-emitting element exhibits total internal reflection within the lens until the light reaches the outer surface.

In another aspect, light fixture includes a housing, a light-emitting element, and a lens extending over the light-emitting element. The housing includes a first end, a second end, and a longitudinal axis extending therebetween. The housing includes a support surface positioned between the first end and the second end. The light-emitting element includes at least one elongated board supporting at least one light-emitting diode (LED). The board defining a first end, a second end, and a board axis extending therebetween. The board coupled to the support surface and oriented such that the board axis is parallel to the longitudinal axis. The lens extends over the light-emitting element and includes a refractor portion having an inner surface and an outer surface. The inner surface is positioned proximate the light-emitting element and oriented at an angle such that the light generated by the light-emitting element exhibits total internal reflection within the lens.

In yet another aspect, a light fixture include a housing, a light emitting element, and a bracket coupled to the housing. The housing includes a first end, a second end, and a longitudinal axis extending therebetween. The housing includes a support surface positioned between the first end and the second end. The light-emitting element is coupled to the support surface. The bracket includes a channel defining an elongated slot oriented parallel to the longitudinal axis, the slot configured to receive a support member.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
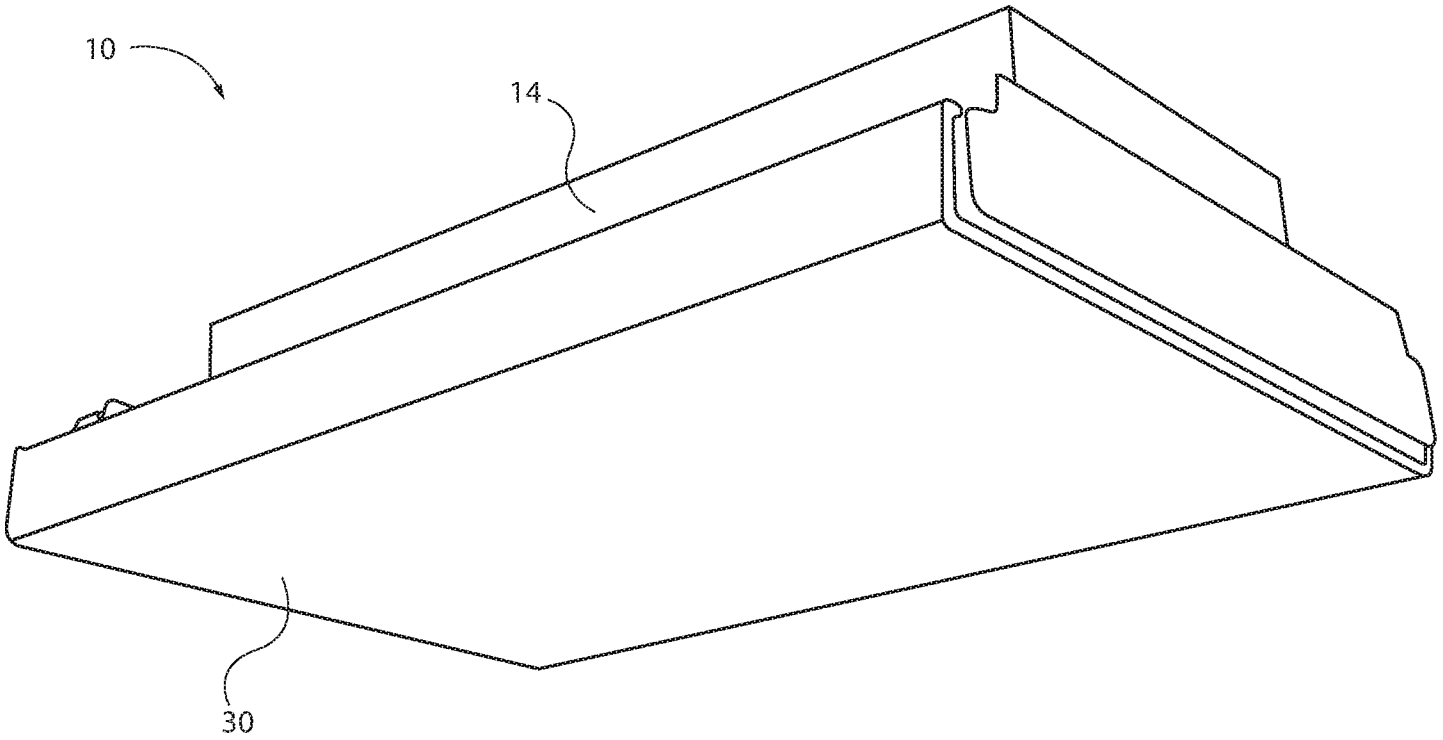
FIG. 1 is a perspective view of a luminaire.
Figure 2:
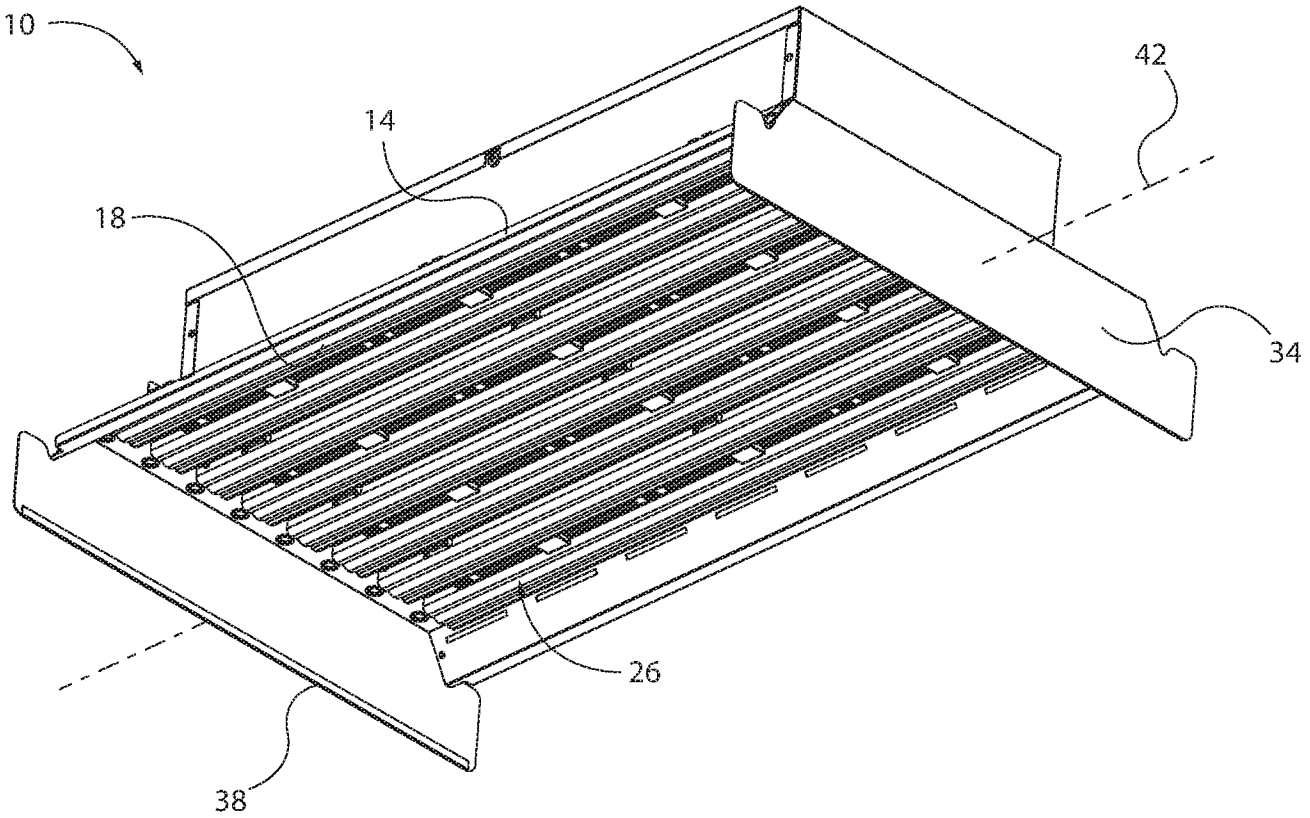
FIG. 2 is a perspective view of the luminaire of FIG. 1 with a cover removed.
Figure 3:
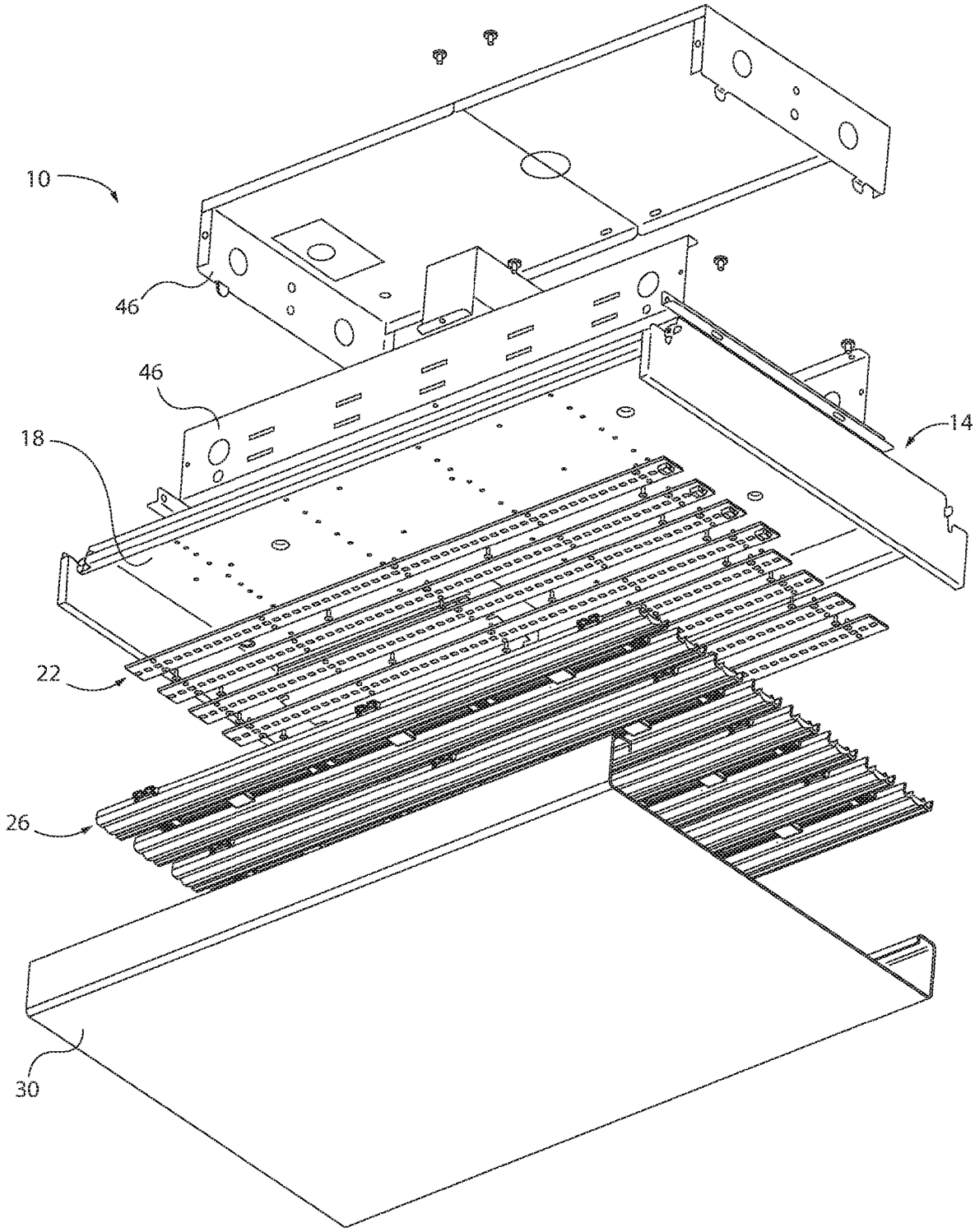
FIG. 3 is an exploded view of the luminaire of FIG. 1.

FIGS. 1-3 illustrate a light fixture or luminaire 10. In one embodiment, the luminaire 10 is used in a commercial or industrial environment. The luminaire 10 includes a housing 14 defining a support surface 18, a light emitting element 22 (FIG. 3) coupled to the housing 14, and a lens 26. In one embodiment, the luminaire 10 also includes a cover 30 (FIGS. 1 and 3) extending over the length of the support surface 18, the light-emitting element 22, and the lens 26. The cover 30 may have hook-shaped sides that engage the housing 14. In some embodiments, the cover 30 is a diffuser that diffuses light generated by the light-emitting element 22. As shown in FIG. 2, the housing 14 includes a first end 34 and a second end 38 and defines a longitudinal axis 42 extending between the first end 34 and the second end 38. The housing 14 may be formed from a sheet of metallic material and is secured to a ceiling (not shown). As shown in FIG. 3, the housing 14 may include a driver or controller enclosure 46 containing controller hardware.

Figure 4:
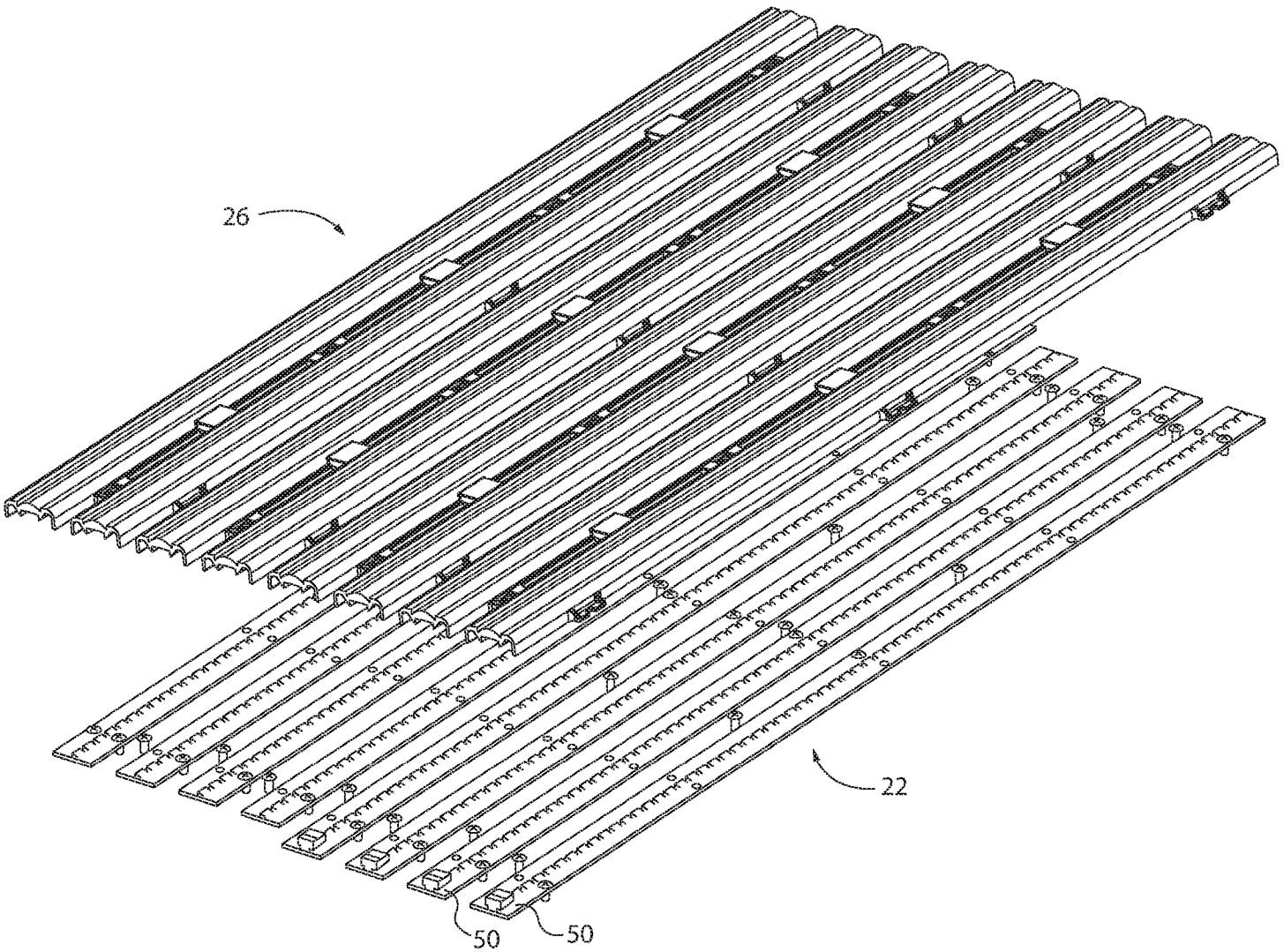
FIG. 4 is an exploded view of a light-emitting element and a lens.

As shown in FIG. 4, the light assembly 22 may include multiple light-emitting diode (LED) boards 50. Each LED board 50 includes multiple LEDs supported on an elongated circuit board (e.g., a printed circuit board or PCB). The circuit board is secured to the support surface 18 (FIG. 3). The LEDs may be arranged in a linear manner along the length of the circuit board, and the LED board 50 may be oriented parallel to the longitudinal axis 42 (FIG. 2) of the housing 14. In the illustrated embodiment, the light assembly 22 includes eight LED boards 50 arranged parallel to one another; in other embodiments, the light assembly 22 may include fewer or more light boards 50.

Figure 5:
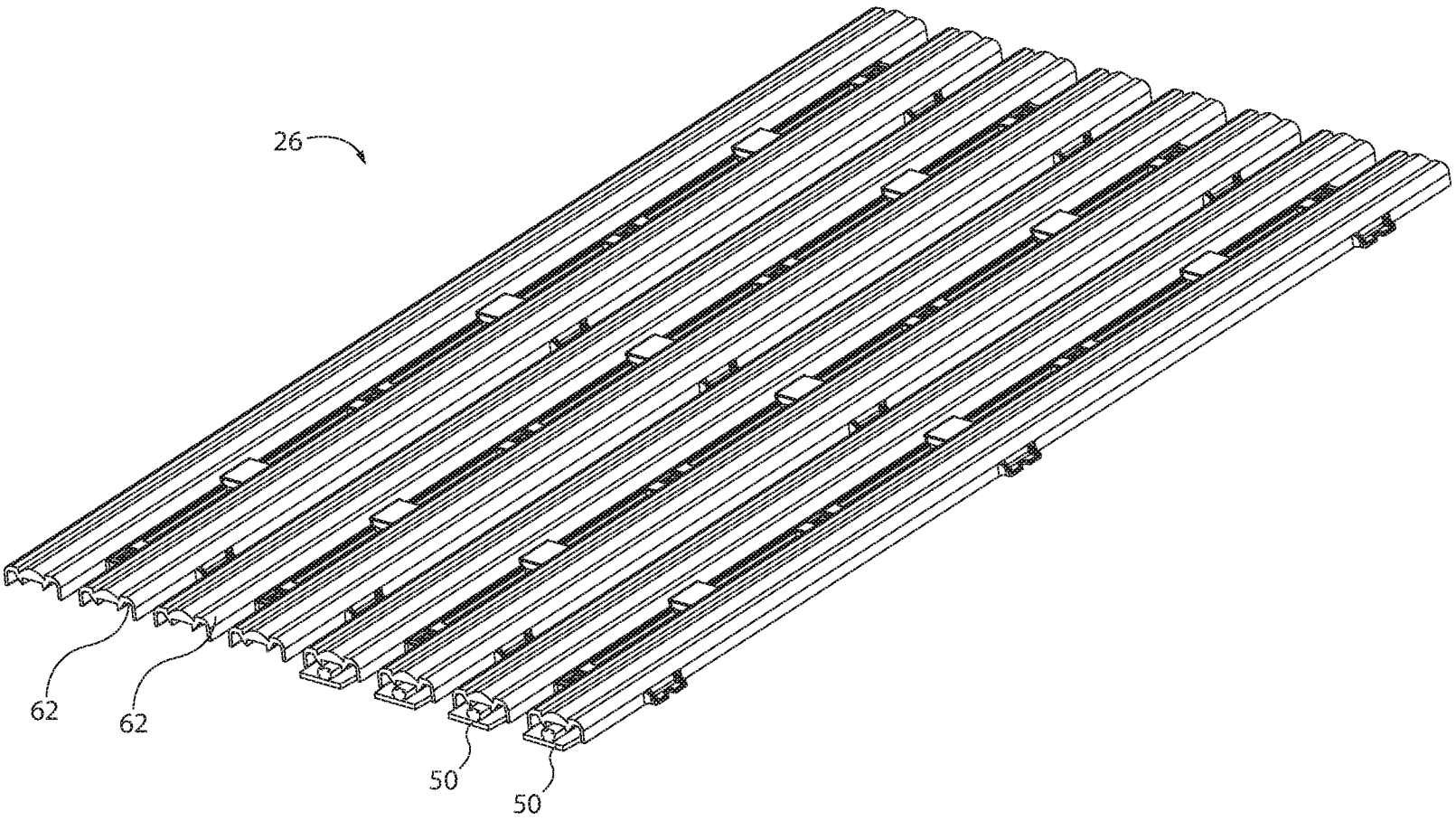
FIG. 5 is a perspective view of the light-emitting element and the lens of FIG. 4.
Figure 6:
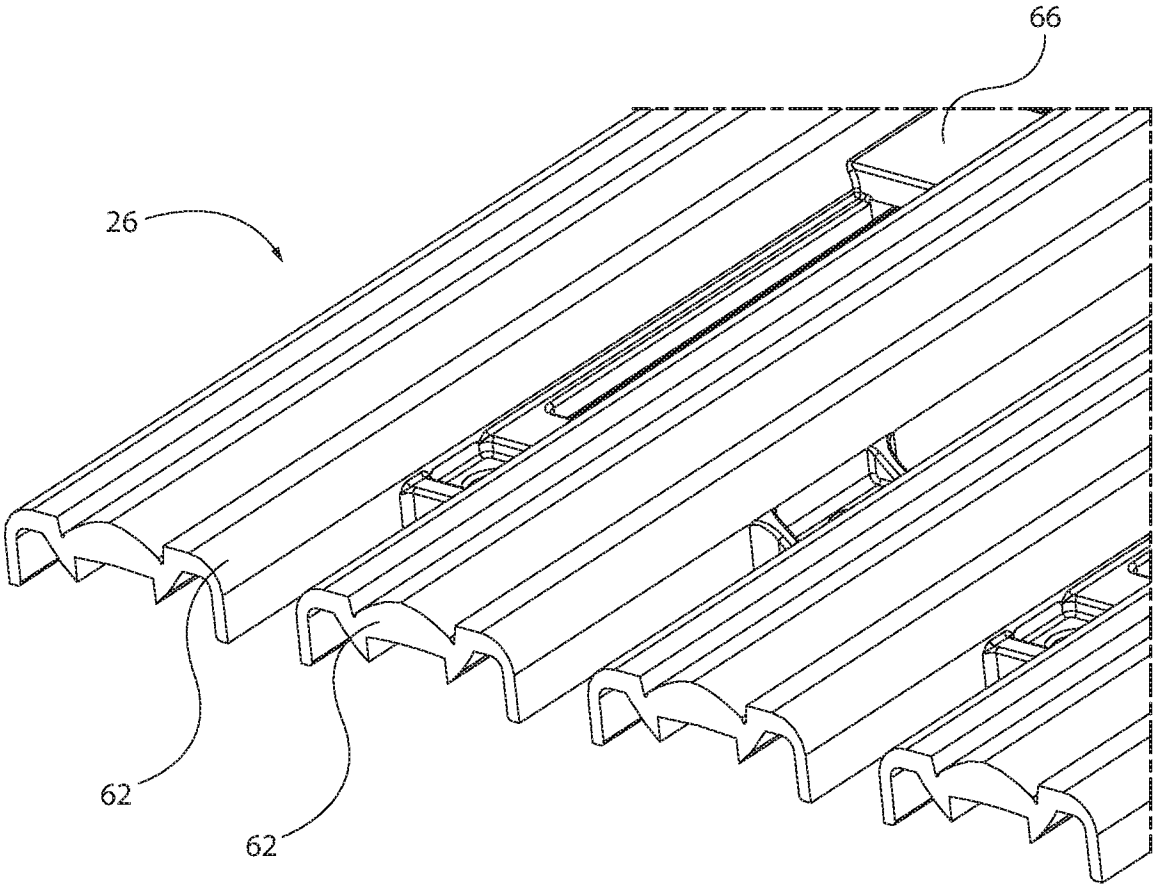
FIG. 6 is an enlarged perspective view of a portion of the lens of FIG. 4.
Figure 7:
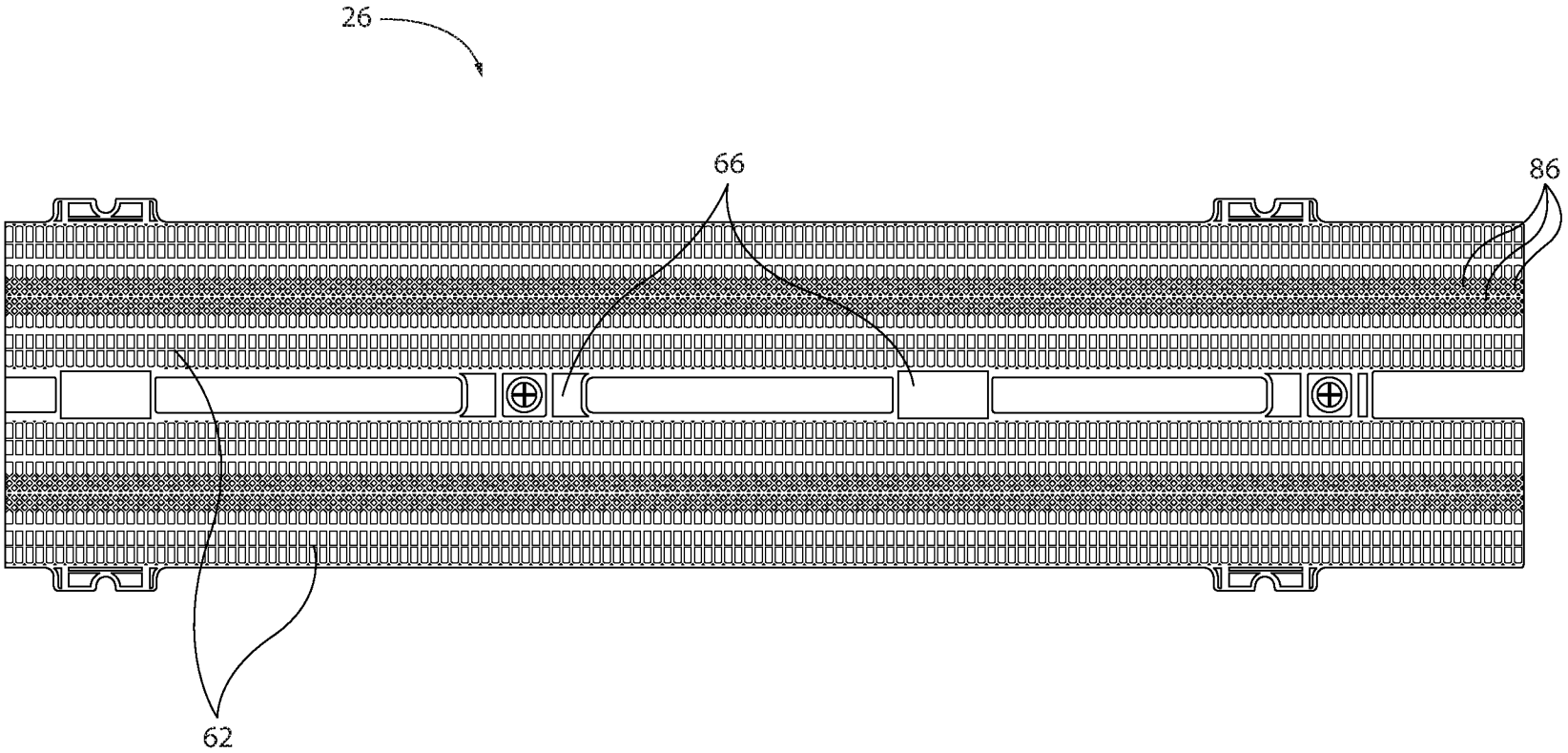
FIG. 7 is a top view of a lens according to another embodiment.

Referring now to FIGS. 5 and 6, the lens 26 includes refractors 62, and each refractor extends over one of the LED boards 50. In some embodiments, each refractor 62 is secured directly to the support surface 18 (FIG. 3) and is formed from an acrylic material. Each refractor 62 may be coupled to one another by connecting portions 66 (FIG. 6) extending laterally between the refractors 62, and the refractors 62 may be formed integrally with one another. In one embodiment, four of the refractors 62 are formed integrally with one another. In other embodiments (FIGS. 7 and 8), two of the refractors 62 are formed integrally with one another. In still other embodiments, fewer or more refractors 62 may be formed together. Forming the refractors 62 integrally with one another reduces the number of connection points and fasteners that must be used to couple the lens 26 to the housing 14.

Figure 8:
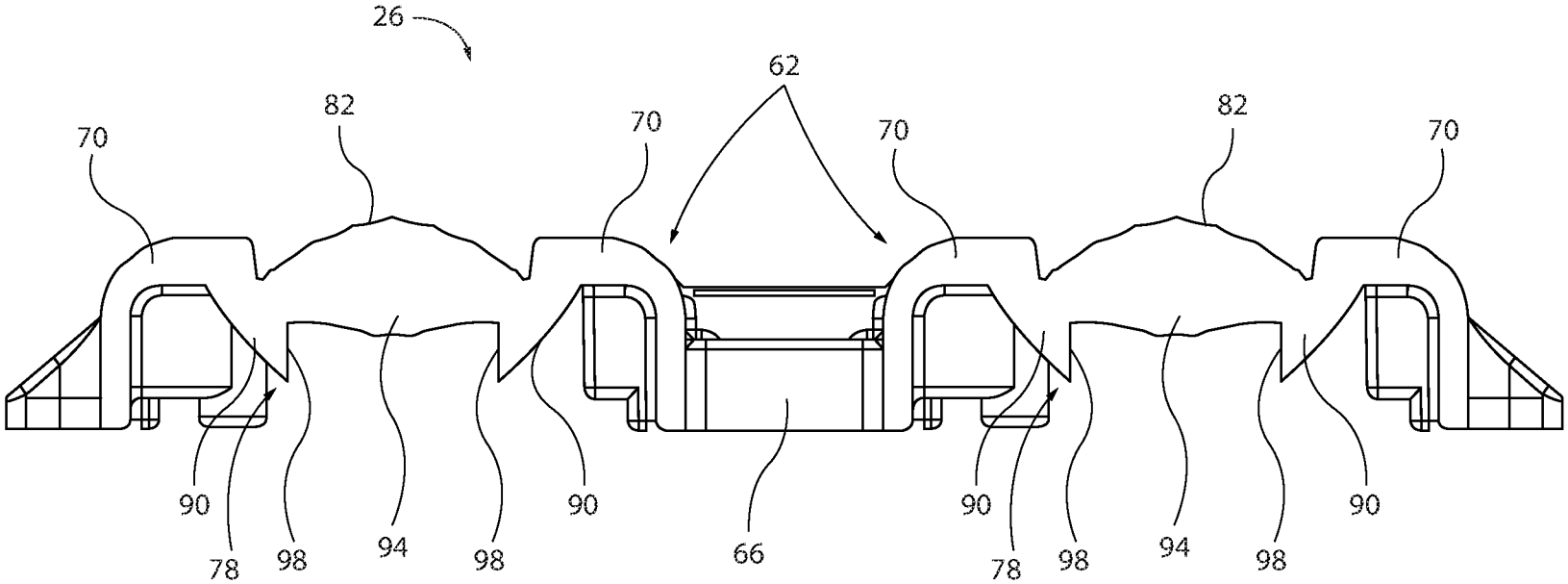
FIG. 8 is an end view of the lens of FIG. 7.
Figure 9:
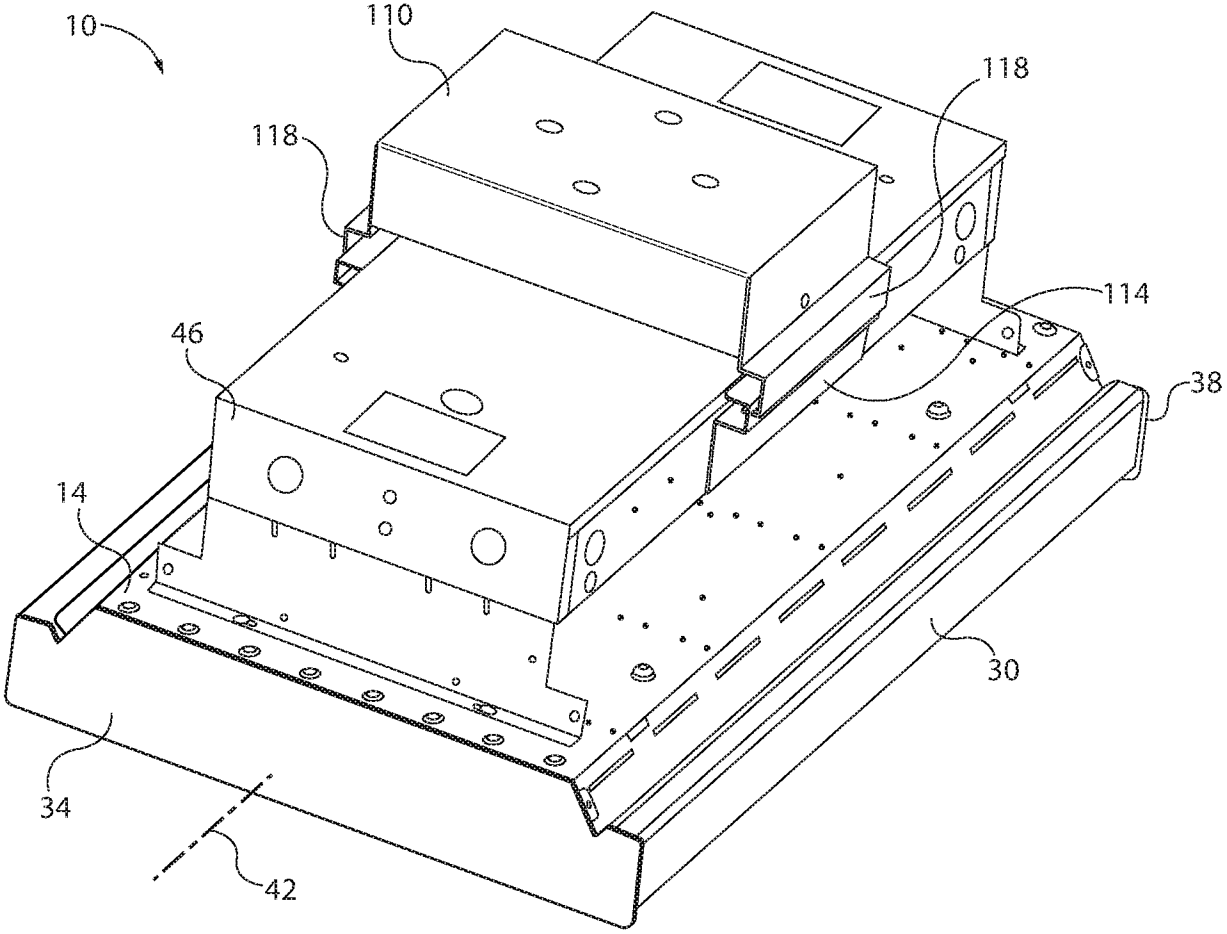
FIG. 9 is a perspective view of the luminaire of FIG. 1 and a support assembly.

As shown in FIG. 8, each refractor 62 includes a pair of side portion 70 extending parallel to one another, and a bridge or refractor portion 74 extending between the side portions 70. The side portions 70 may curve through an angle of approximately 90 degrees. The refractor portion 74 has an inner surface 78 positioned proximate the LEDs and an outer surface 82 facing opposite the inner surface 78. In the illustrated embodiment, the outer surface 82 has a convex shape extending outwardly with respect to the LED board 50. The outer surface 82 has sides that are recessed below the side portions 70, but the apex of the outer surface 82 extends above the side portions 70. In the illustrated embodiment, the outer surface 82 has diamond shaped formations 86 (FIG. 7) formed on the surface 82.

In the illustrated embodiment, the inner surface 78 includes a pair of transition portions 90 and a center portion 94 extending between the transition portions 90. The transition portions 90 have a curved, convex shape extending downwardly toward the support surface 18 (FIG. 3). The center portion 94 forms a slot or recess between the transition portions 90 to accommodate the LEDs. The slot is formed by walls 98 that are generally straight. The junction between the transition portion 90 and each wall 98 forms an edge. In one embodiment, the center portion 94 has a slight curvature extending inwardly toward the LED. The center portion 94 has a slight groove positioned adjacent the LEDs and extending along the LED board 50.

The structure of the refractor 62 causes the light emitted by each LED to be totally internally reflected (TIR) from the inner surface 78 until it reaches the outer surface 82. The light leaves the outer surface 82 along a linear path parallel to the longitudinal axis 42. The refractor 62 focuses the light output by the LED board 50 such that the light is distributed along a linear path (also known as linear aisle lighting or "LAL") without the need for a reflector. In one embodiment, each refractor 62 directs light output from the LEDs toward a vertical surface of a retail shelf (not shown) to provide a desired illuminance or light intensity while requiring a lower power consumption than conventional light fixtures. In one embodiment, the LED board 50 is powered by a power source providing 90-110 watts, and the board 50 and refractor 62 provide 25 foot-candles at a vertical height of 14 feet. Each refractor may be optically clear and stabilized with respect to ultraviolet (UV) light, and each refractor may have a refractive index of approximately 1.49.

The housing 14 design provides a compact fixture while providing high light output. In addition, the fixture 10 may include a cover 30 (FIG. 1), such as a smooth frosted acrylic wrap lens, to provide a wide light distribution to minimize glare and mimic the appearance of a skylight.

Figure 10:
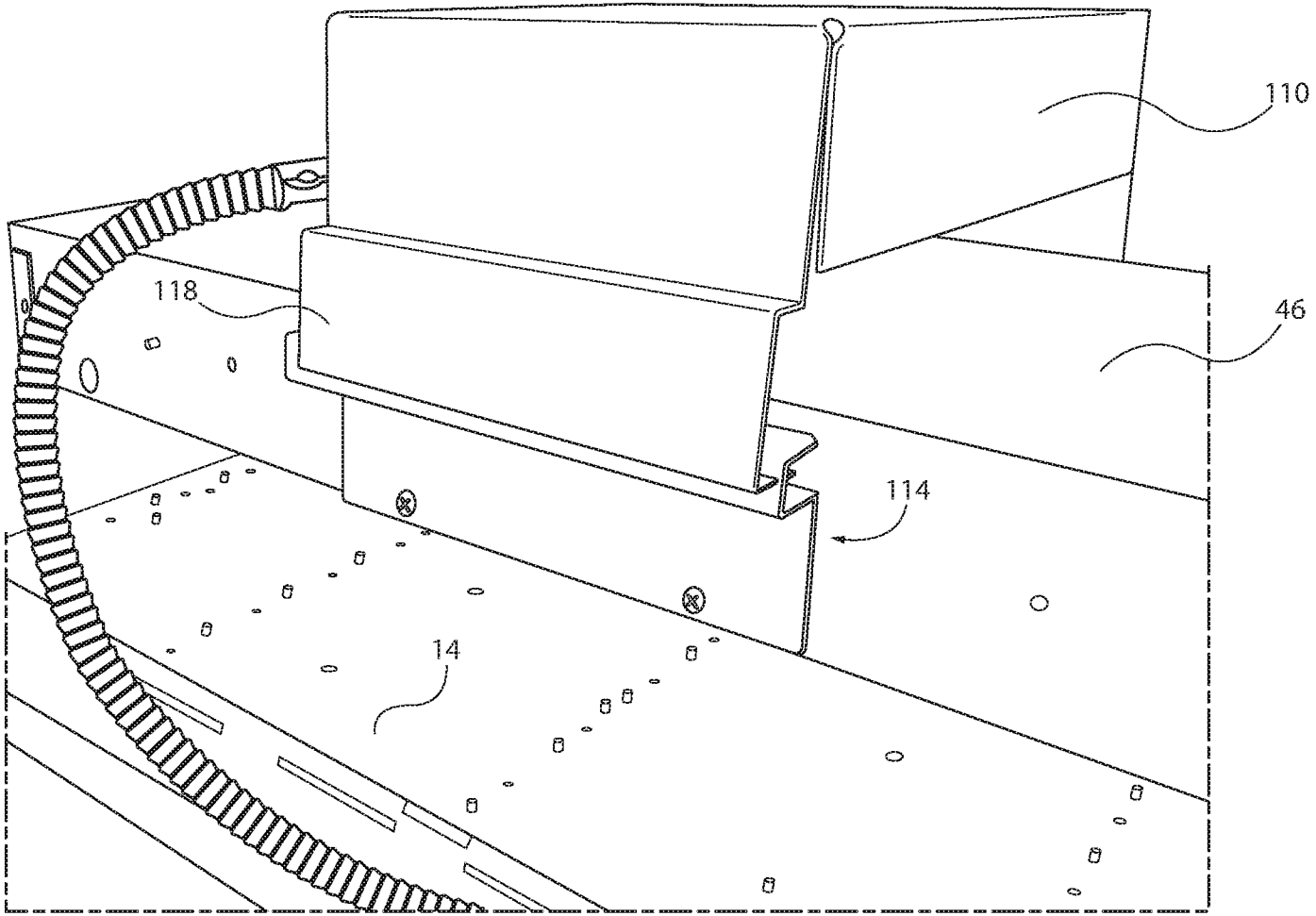
FIG. 10 is a perspective view of the support assembly of FIG. 9 and a portion of the luminaire.
Figure 11:
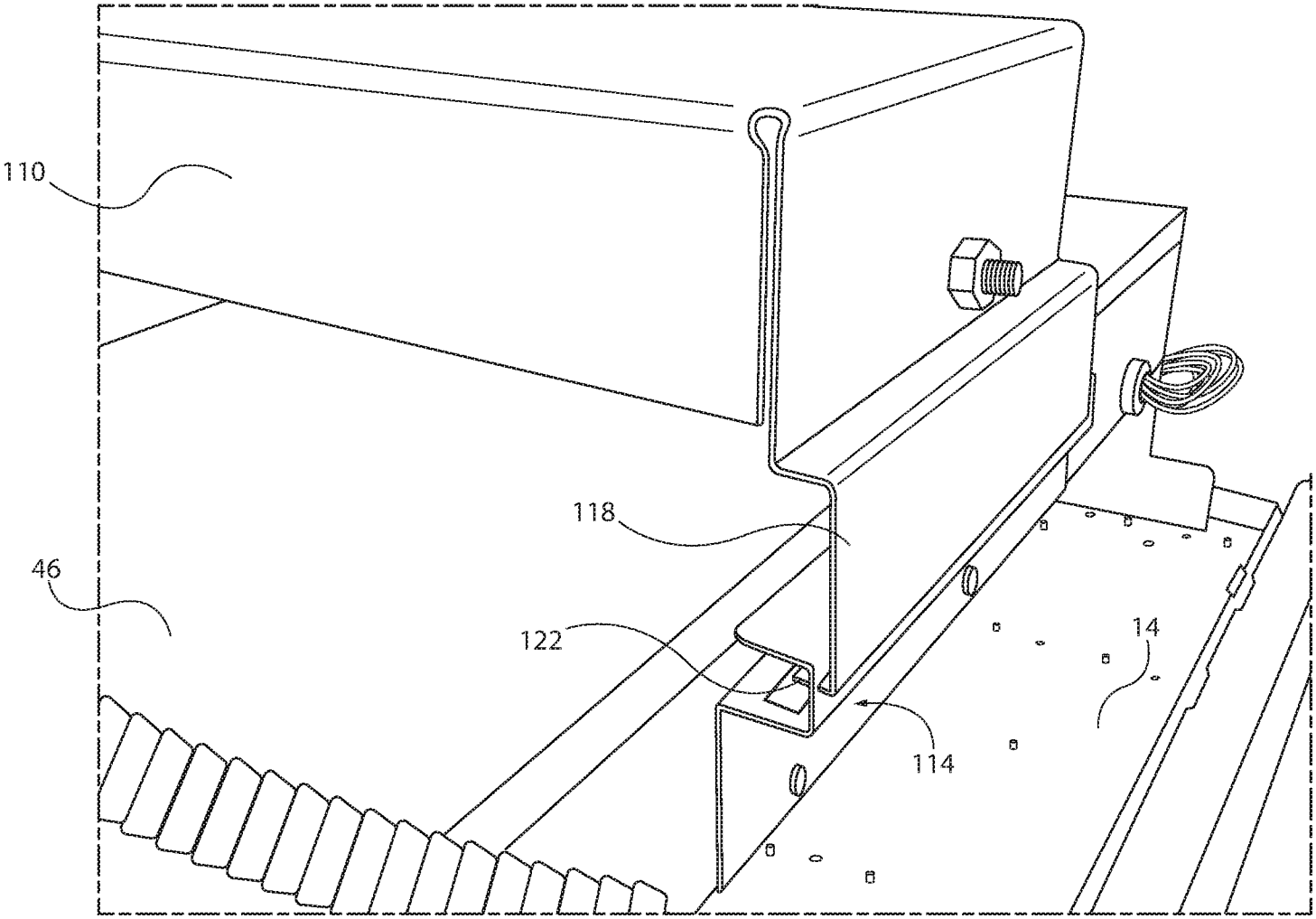
FIG. 11 is a perspective view of the support assembly of FIG. 9 and a portion of the luminaire.

FIGS. 9-14 illustrate a support assembly for supporting the luminaire 10 (e.g., suspending the luminaire 10 from a ceiling). As best shown in FIGS. 10 and 11, the support assembly includes a support member 110 coupled to a wall or ceiling surface (not shown) and a pair of brackets 114, each of the brackets 114 coupled to one side of the luminaire 10. In the illustrated embodiment, the support member 110 includes a pair of arms 118 extending parallel to the longitudinal axis 42 (FIG. 2) of the housing 14. Each bracket 114 also extends parallel to the longitudinal axis 42. Each arm 118 includes an end 122 including a finger or hook extending inwardly toward the axis 42 (FIG. 2). The ends 122 the arms 118 engage one of the bracket 114.

Figure 12:
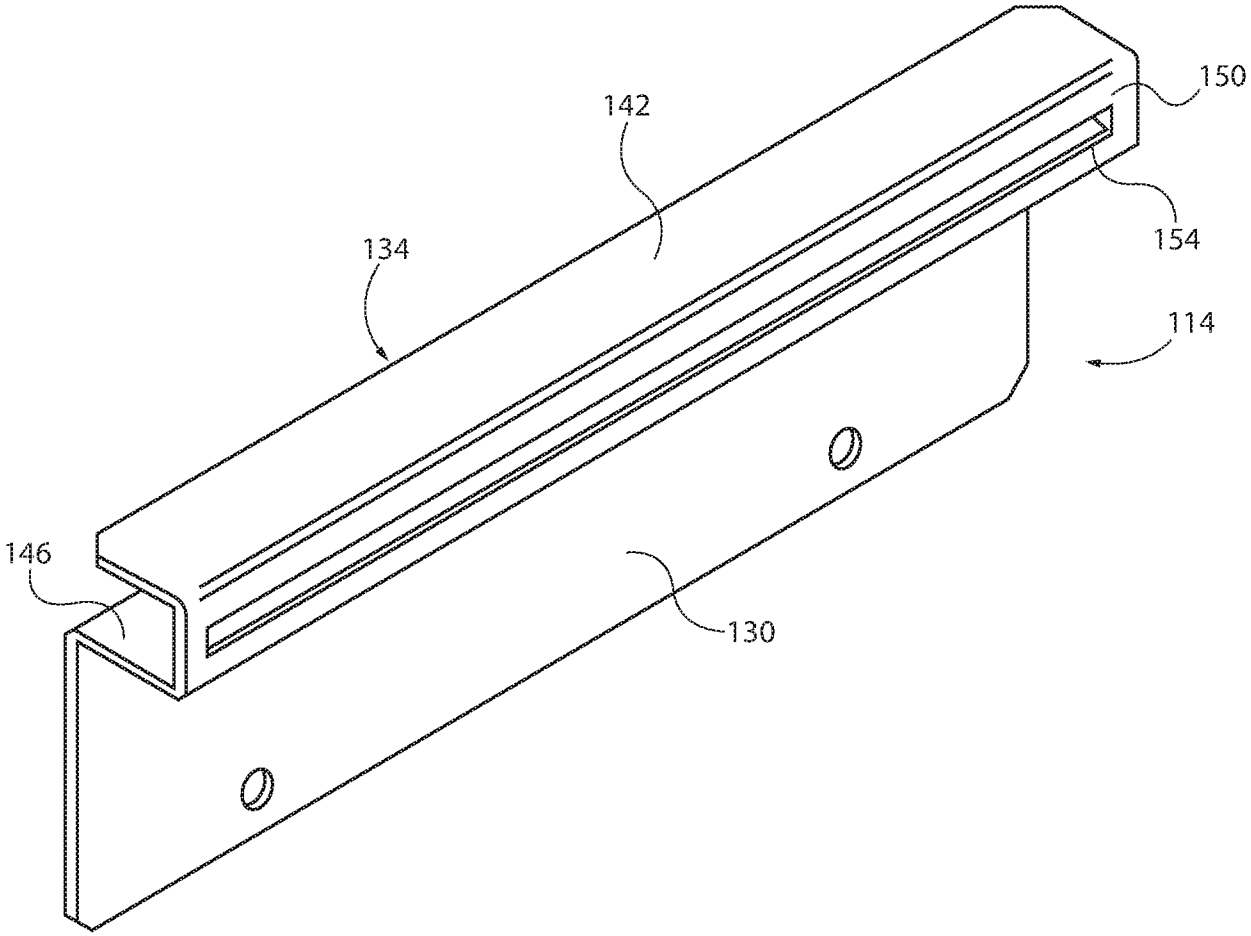
FIG. 12 is a perspective view of a bracket.
Figure 14:
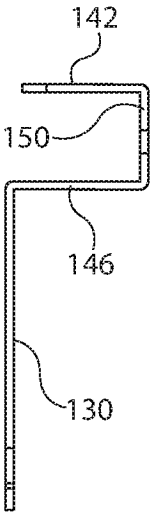
FIG. 14 is an end view of the bracket of FIG. 12.
Figure 13:
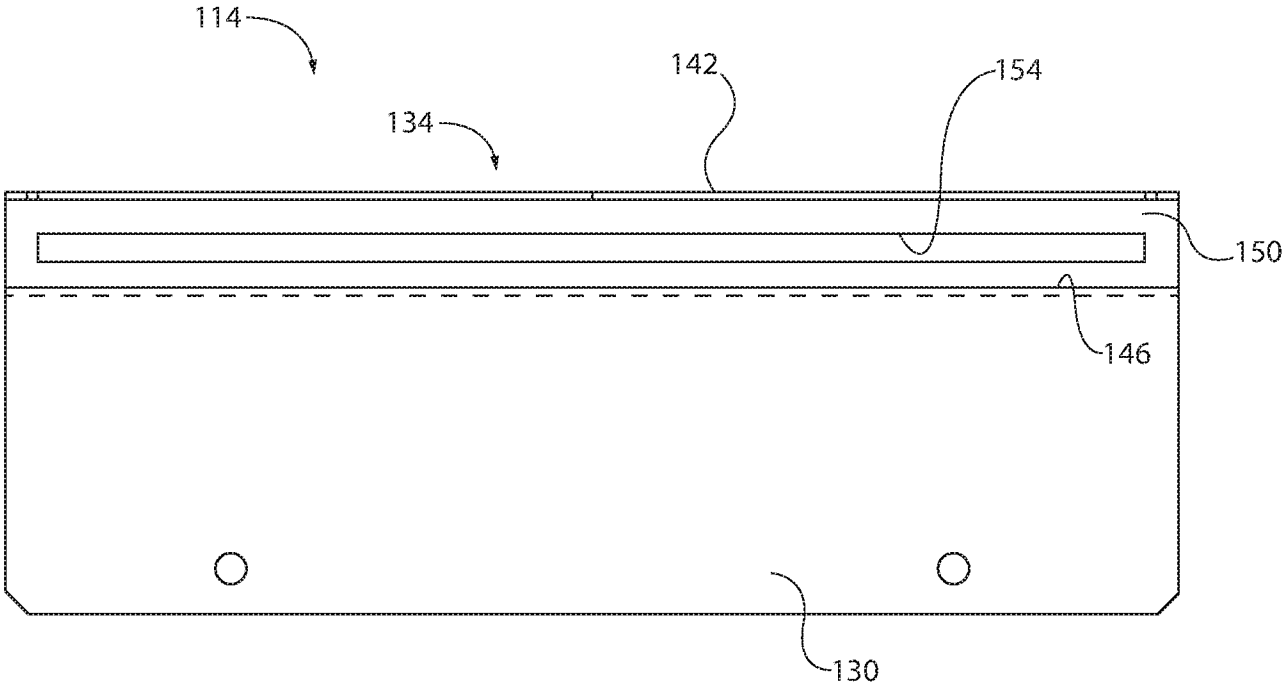
FIG. 13 is a side view of the bracket of FIG. 12.

Referring to FIGS. 12-14, the bracket 114 includes a first portion 130 and a second portion 134. In the illustrated embodiment, the first portion 130 is secured to a side wall of the controller enclosure 46, and the second portion 134 is formed as a C-shaped channel positioned along an upper edge of the first portion 130. The C-shaped portion forms a first or upper leg 142, a second or lower leg 146, and a third leg or bridge 150 extending between the upper leg 142 and the lower leg 146. In the illustrated embodiment, the bridge 150 includes an elongated slot 154 extending parallel to the longitudinal axis of the bracket 114 and parallel to the longitudinal axis 42 (FIG. 2) of the luminaire 10. Each end 122 of the arms 118 of the support member 110 is received within one of the slots 154 and positioned between the first leg 142 and the second leg 146, thereby coupling the luminaire 10 to the support member 110 to support the luminaire relative to a ceiling or wall surface. In other embodiments, the bracket 114 may be formed in another manner to provide another type of engagement between the bracket 114 and the support member 110.

Although certain embodiments have been described in detail, variations and modifications exist within the scope and spirit of one or more independent aspects as described.

What is claimed is:

1. A light fixture comprising:

a housing including a first end, a second end, a mounting surface, and a light emitter support surface extending substantially between the first end and the second end, the mounting surface including a bracket configured to be coupled to an overhead support, the light emitter support surface facing in a direction substantially opposite the mounting surface;

a plurality of light-emitting elements coupled to the light emitter support surface, the light emitting elements positioned in a plurality of parallel rows extending substantially between the first end and the second end, each of the rows coupled to the light emitter support surface, the light emitting elements of each row oriented to emit light in the same direction as the light emitting elements of the other rows; and a lens extending over the light-emitting elements, the lens including a refractor portion having an inner surface and an outer surface, the inner surface positioned proximate the light-emitting element, the inner surface oriented at an angle such that the light generated by the light-emitting element exhibits total internal reflection within the lens, wherein the bracket includes a channel defining an elongated slot oriented parallel to a longitudinal axis extending between the first end and the second end of the housing, the slot configured to receive a support member, and wherein the channel has a C-shaped cross-section defining a first leg, a second leg, and a third leg extending between the first leg and the second leg, wherein the slot is positioned on the third leg.

2. The light fixture of claim 1, wherein each of the light-emitting elements is at least one light-emitting diode (LED) supported on a board, the board coupled to the light emitter support surface of the housing.

3. The light fixture of claim 2, wherein the board is oriented in a direction parallel to a longitudinal axis extending between the first end and the second end, wherein the lens is oriented parallel to the longitudinal axis.

4. The light fixture of claim 1, wherein the lens includes a plurality of lenses, each of the lenses extending over an associated one of the rows of light-emitting elements.

5. The light fixture of claim 1, wherein the lens is coupled to the light emitter support surface of the housing.

6. The light fixture of claim 1, wherein light emitted through the lens exhibits a substantially linear distribution oriented parallel to a length of the lens.

7. The light fixture of claim 1, wherein the outer surface includes a plurality of diamond-shaped formations.

8. The light fixture of claim 1, wherein a portion of the inner surface has a convex shape curving from a position away from the light-emitting element toward the light-emitting element.

9. The light fixture of claim 1, further comprising a diffuser coupled to the housing and extending over the light-emitting elements and the lens.

10. The light fixture of claim 1, wherein the inner surface of the lens is positioned directly adjacent the light-emitting elements.

* * * * *